United States Patent [19]

Skalleberg

[11] 4,026,483

[45] May 31, 1977

[54] DEVICE FOR AN APPARATUS FOR COILING OF CABLE, WIRE, WIRE ROPE OR THE LIKE

[75] Inventor: Oystein Gunnar Skalleberg, Jarfalla, Sweden

[73] Assignee: Skaltek AB, Jarfalla, Sweden

[22] Filed: Jan. 21, 1975

[21] Appl. No.: 542,710

[30] Foreign Application Priority Data

Jan. 25, 1974 Sweden ..... 7400981

[52] U.S. Cl. ..... 242/25 R; 242/19; 242/80; 242/81

[51] Int. Cl.[2] ..... B65H 54/02

[58] Field of Search ..... 242/25 R, 25 A, 19, 242/78, 80, 81

[56] References Cited

UNITED STATES PATENTS

| | | | |
|---|---|---|---|
| 1,915,113 | 6/1933 | Wood et al. | 242/25 R X |
| 2,420,936 | 5/1947 | Davis | 242/81 |
| 2,598,537 | 5/1952 | Hanson | 242/80 |
| 2,631,788 | 3/1953 | Cerasani | 242/25 R |
| 2,698,145 | 12/1954 | Winkler | 242/80 |
| 2,829,845 | 4/1958 | Loop | 242/25 R X |
| 2,944,755 | 7/1960 | Foster | 242/80 |
| 2,985,401 | 5/1961 | Gazet | 242/81 |

*Primary Examiner*—Stanley N. Gilreath

[57] ABSTRACT

An automatic coiling machine steering and cutting a cable in conjunction with its reeling on a reeling device while forming coils, said machine comprising a steering unit movable in a plane substantially perpendicular to the geometrical central axis of the formed coils between two end positions, said steering unit cutting off the cable under the action of a control unit so as forcibly to move it against a knife when the desired number of coil windings has been formed.

9 Claims, 5 Drawing Figures

DEVICE FOR AN APPARATUS FOR COILING OF CABLE, WIRE, WIRE ROPE OR THE LIKE

Figure 1:
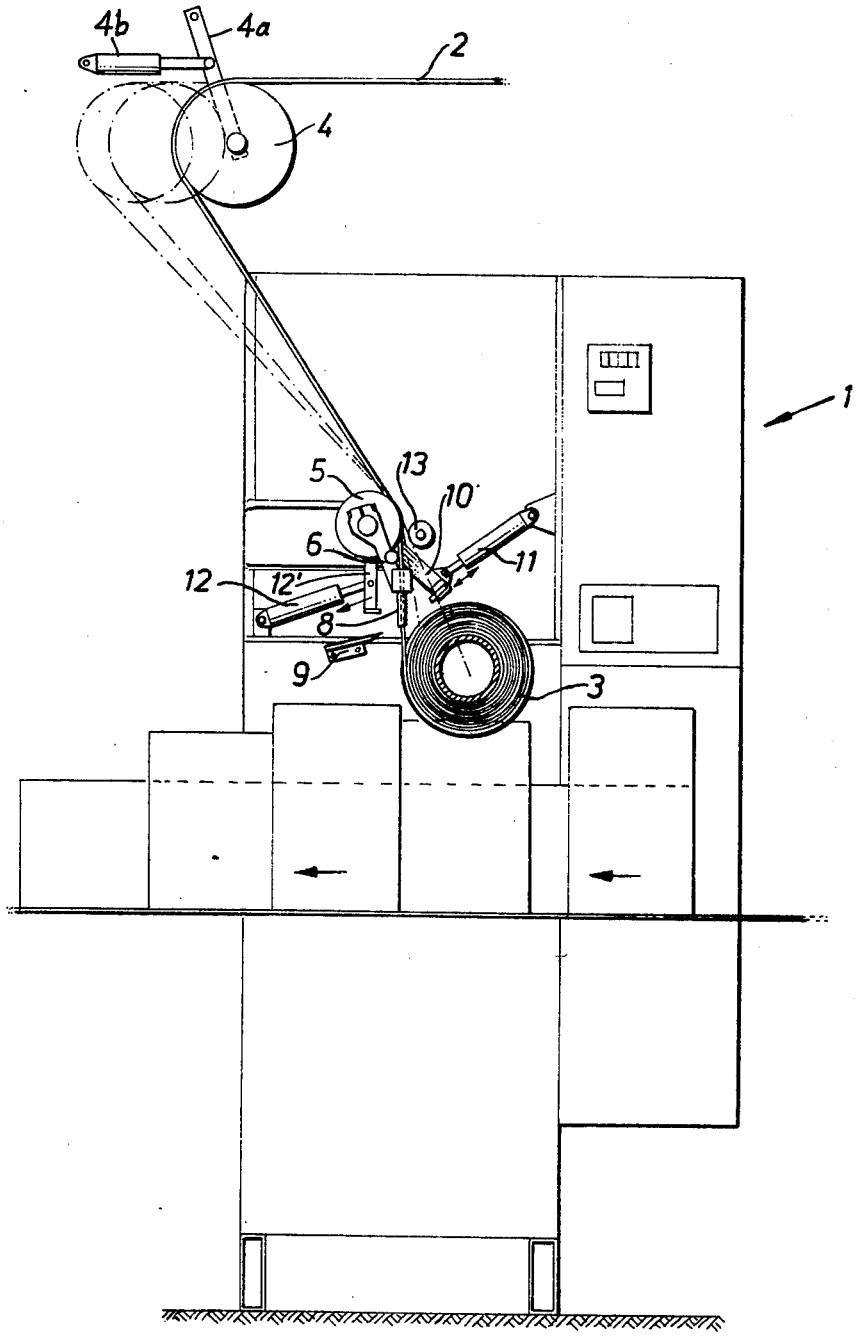

The invention relates to a device for an apparatus for coiling of cable, wire, wire rope or the like, preferentially an automatic coiling machine, designed for steering and cutting of the cable etc. in conjunction with its reeling on a reeling device for formation of coils.

An often complicated problem in conjunction with automatic coiling machines of this kind is that they must work at high speeds. This means that when a coil, i.e. a number of adjacent turns of cable, has been formed on a reeling device, the cable must be cut off, the coil removed and the cable-end fixed in the reeling device, without any major interruption in the cable feed occurring. For this purpose the coils are usually wound up on a take-up drum, the hub of which is axially displaceable so that the laid coils can fall out between the flanges of the drum.

A number of different devices of this kind are known, which, however, have the common disadvantage that they are relatively complicated and that they cannot operate reliably at high speeds.

The invention has as its object to eliminate these drawbacks and consists of a device for an apparatus for coiling of cable, wire, wire rope or the like, preferentially an automatic coiling machine, designed to steer and cut the cable etc. in conjunction with its reeling on a take-up drum for formation of coils. The especial characteristic of the invention is that the device contains a steering unit or cable feeding and guiding assembly which in addition to lateral reciprocatory movement thereof in a direction parallel to the axis of the takeup drum is also rotatable in a plane substantially perpendicularly to the axis of the take up drum, the assembly being effective after a coiling operation to cut the cable under action of a control unit, which forcibly brings the cable up against a knife edge when the desired number of coil windings has been formed.

Through this arrangement the steering unit can be used both for guiding of the cable etc. during the coiling and for cutting of the cable etc. the steering unit for this purpose being arranged rotatably around a revolving shaft and being displaceable along it between two end positions. The steering unit may suitably consist of a tube through which the cable etc. is fed.

According to an advantageous embodiment of the invention the steering unit or feeding and guiding assembly, in one rotative position remote from the knife-edge (FIG. 2), is arranged to bring the cable etc. into engagement with a feed mechanism for feed of the cable to the take-up drum. Accordingly, when the cable has been cut (FIG. 3) after completion of laying of a coil, the steering unit is rotated automatically to the position where the cable is brought into engagement with the feed mechanism, so that the free cable-end is fed forward to the take-up drum and is clamped there between one of the flanges and the hub of the drum, the hub having been moved aside for collection of the coil that has just been formed.

In the case of automatic coiling machines which operate at very high speeds it may be advisable to arrange two take-up drums side by side so that, after cutting of the cable, the steering unit is carried onward in its direction of movement for coiling on the second drum. The knife must in such case, of course, have two edges.

Figure 4:
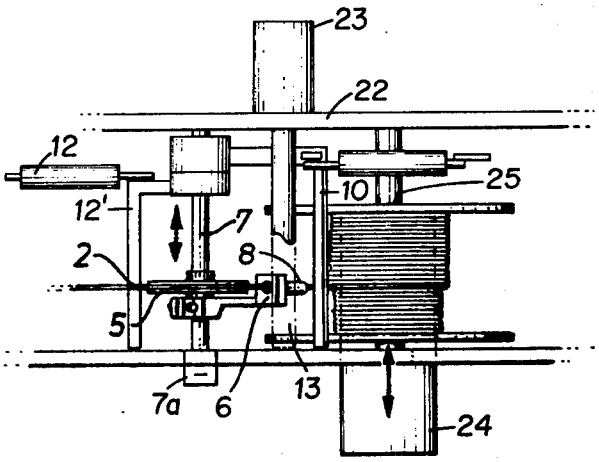
Figure 5:
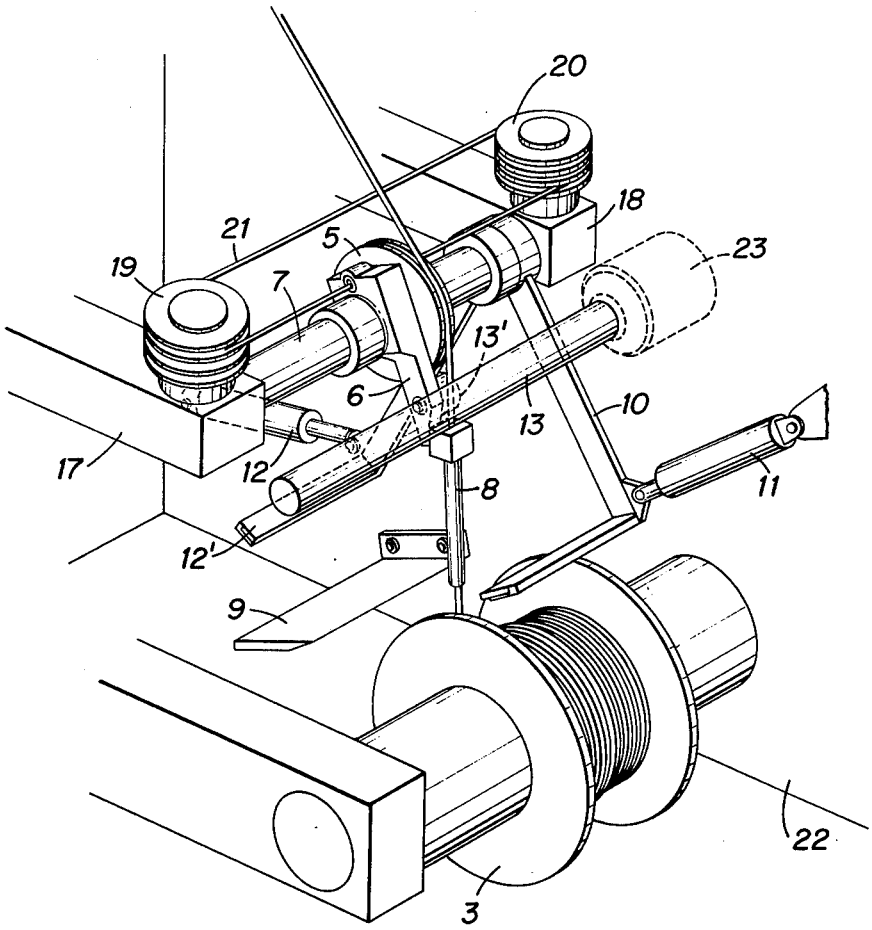

One embodiment of the invention will now be described with reference to the attached drawings, of which FIG. 1 shows a side view of an automatic coiling machine equipped with a device according to the invention, FIG. 2 a detail of FIG. 1 showing the device according to the invention from the side in the position for commencement of reeling of the cable, FIG. 3 the same as FIG. 2 but showing the device in position for cutting of the cable and FIG. 4 the same detail as in FIGS. 2 and 3 but showing the device viewed from above during coiling of the cable on the drum, and FIG. 5 is a perspective view of the apparatus showing the details of FIGS. 2 and 3 and showing alternate means for traversing the cable guiding means.

FIG. 1 shows an automatic coiling machine 1 in which the cable 2 is wound up on a take-up drum 3 for formation of a coil consisting of several turns. The cable is fed over a pulley 4 to a device according to the invention for feeding, guiding and cutting of the cable. The pulley 4 is mounted at the end of an arm 4*a* which is pivotally secured at its opposite end to a stationary fixed member such as a machine standard. The arm 4*a* is adapted to be moved by a piston so under an arrangement between the positions shown in full lines and the position shown in dotted lines of FIG. 1. The device according to the invention, which is shown more clearly in two different positions in FIGS. 2 and 3, contains a pulley 5 and an arm 6 which are mounted on a rotatable bar or shaft 7 for both movement along the axis thereof for laying the cable in predetermined relation on the take-up drum and for relative rotative movement with respect thereto for cutting the cable after laying a predetermined number of cable turns on the drum. The arm 6 as seen in FIGS. 1 to 3, is partially formed as a tube 8 through which the cable 2 runs during its coiling on the drum 3.

As suggested by the oppositely directed arrow in FIGS. 4 and 5 the pulley 5 and arm 6 are movable in opposite directions along rotating shaft 7, so that the cable can be laid in closely adjacent turns. One means for effecting the traverse of the pulley 5 and the arm 6 may be obtained by mounting the shaft so that it is rotatable about its own axis via motor 7*a*. The shaft 7 is provided with a double helix and the hub of the arm 6 with a pin engaging within the grooves of the helix. On rotation of the shaft 7, the arm will thus traverse and reverse itself upon reaching either end. Another means for traversing the pulley 5 and the arm 6 is indicated in FIG. 5. Here the shaft 7 may remain fixed and the hub of the arm 6 being slidable across it. A continuous rope 21 is attached to the hub on either side of the pulley 5 and wound about pulley capstans 19 and 20 in a continuous manner. Either or both of the capstans 19 and 20 may be driven by unidirectional or reversible motors, housed in the machine supports 17 and 18 and arranged with suitable switch means which causes reversal of the capstans when pulley 5 and arm 6 reach either end of the shaft 7.

Close to the cable feeding side of the cable drum 3, and just below the highest point of the coil formed on the reeling device, there is a knife 9 against which the cable is cut after the desired number of turns of cable have been wound on the drum. This is done by movement of the tube 8 in the direction of the knife edge as shown in FIG. 3. In the embodiment illustrated in the figures this is effected by a hammer 10 operated by a hydraulic cylinder 11. When the desired number of turns of cable have been wound on the drum, a pressure pulse is applied to the hydraulic cylinder 11, so that the hammer 10 strikes with force against the tube 8, the tube being thus rotated around the shaft 7 in a direction toward the knife edge so that (a) the cable is cut against the edge of the knife 9 and (b) the cable is simultaneously moved away from a driving roll 13.

When the cable is cut the hub of the drum is drawn out and moved into position 24, as appears from FIG.4, so that the laid coil can fall freely out from the drum.

Figure 2:
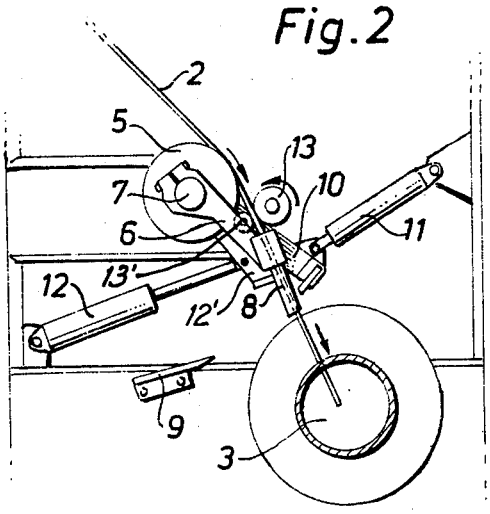
Figure 3:
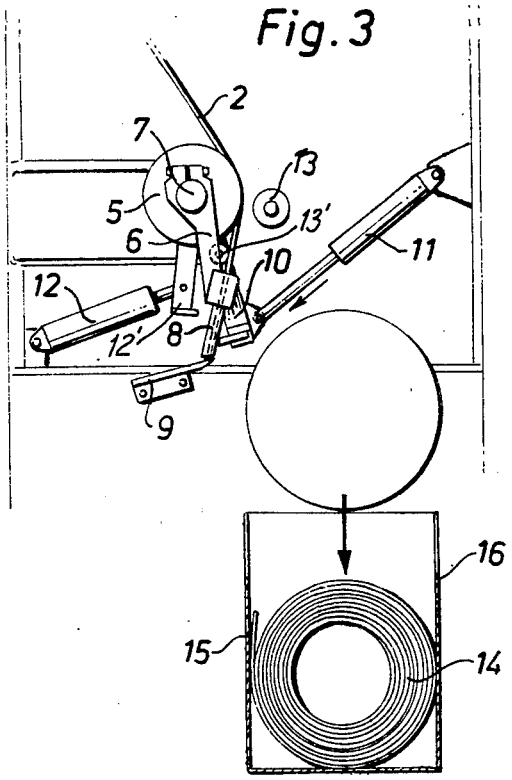

Ater the cable has been cut, the arm 6 and thereby the entire cable feeding and guiding assembly is moved about shaft 7 under the influence of an element 12' connected to the end of a piston of a hydraulic cylinder 12 from the position shown in FIG. 3 to that shown in FIG. 2. The cable is thus brought up against the rotatable roll 13 which, drives the cable-end in the direction of the drum 3, while the hub is still withdrawn. The rotatable drive roll 13 is rotatably mounted between walls 22 of the machine and is rotated by suitable drive means such as motor 23. The roll 13 is arranged in parallel relation to the take-up drum and shaft. When the cable feeding and guiding assembly is reciprocated along shaft 7, the cable is guided into contact with the drive roll 13 for feeding thereby onto the take-up drum which is driven by drive shaft 25. Maintenance of cable 2 in engagement with the drive roll is assured by the biasing of arm 6 into a forward rotative position, as shown in FIGS. 1, 2 and 4, under the influence of the hydraulic cylinder 12. A pressure roll 13', carried on arm 6, presses cable 2 against drive roll 13 when arm 6 is in the position shown in FIG. 2. When the cable-end has assumed roughly the position shown in FIG. 2 in relation to its position shown in FIG. 3, the hub of the drum is drawn in again so that the cable is clamped between one end of the hub and one flange of the drum, after which coiling of the cable starts once again.

Immediately before the cable is cut, the pulley 4 is moved slightly aside, as illustrated by dotted lines in FIG. 1, for paying out a length of cable. When the cable is thereafter cut and the arm 6 moved to the position shown in FIG. 2, where the cable 2 is brought between the drive roll 13 and pressure roll 13', the pulley 4 is again moved to the position shown by the fully drawn line in FIG. 1, causing the cable to slack so that it can easily be fed forward to the take-up drum 3.

The formed coils fall by gravity into boxes, which are carried, for example on a conveyor belt, through the automatic coiling machine in synchronism with the coiling work.

In the figures the knife 9 is shown for the sake of clarity at a relatively large distance from the drum, but in practice it is so placed that it is very close to the cable every time a coil is completed. It is advisable that the knife should be slightly resiliently mounted. It should also be observed that the knife should preferably be placed so that its edge is below the uppermost level of the formed coils. The special advantage of this appears best from FIG. 3. The completed coil 14 is here shown in a package 16 and, as appears from the figure, the free cable-end 15 is below the highest level of the coil. This enables the package to be closed without the need first to bend down the free cable-end by hand. The latter measure is necessary for coils formed in known automatic coiling machines.

The device according to the invention makes it possible for an automatic coiling machine to operate rapidly and effectively and requires little maintenance.

Although the invention has been described with reference to one of its embodiments, it can nevertheless be varied within the scope of the subsequent claims.

What is claimed is:

1. An automatic coiling machine for winding a cable onto a take-up drum and for cutting the cable when a coil of predetermined size has been wound thereon comprising in combination: a rotatable take-up drum and means for supporting said drum in a predetermined orientation, means for supporting a cable guiding assembly in parallel relation to said take-up drum; a cable guiding assembly mounted on said support means for swinging thereabout and for axial movement therealong, and means for feeding said cable to said take-up drum; a cutting knife mounted intermediate said guide assembly and drum in proximate relation to said drum; and means for swinging said guiding assembly between a first position in which the cable is moved into contact with said feed means and fed to said take-up drum, an intermediate second position in which the guiding assembly is freely swingable about the shaft and a third position in which the movement of the cable to said feed means is interrupted and said cable is guided into engagement with said knife for cutting thereby.

2. An automatic coiling machine according to claim 1, wherein said support means comprises a shaft and said assembly is rotatable about said shaft in a plane substantially perpendicular to the axis of said take-up drum.

3. An automatic coiling machine according to claim 2 wherein means is provided for moving said assembly reciprocably along said shaft.

4. An automatic coiling machine according to claim 1, wherein said take-up drum support means is adapted to support said drum at an elevation so as to insure that the uppermost turns of the coil thereon are above the level of said cutting knife.

5. An automatic coiling machine according to claim 2, wherein said assembly includes a feed tube dimensioned to permit cable to be fed therethrough for coiling about said take-up drum.

6. An automatic coiling machine according to claim 1, wherein said means for rotating said assembly from said first position to said second position includes a hydraulic cylinder actuable to engage said assembly when a predetermined number of coil turns have been wound upon said take-up drum and to rotate said assembly to effect a cutting of the cable by said knife.

7. An automatic coiling machine according to claim 1, wherein said means for rotating said assembly from said second position to said first position includes a hydraulic cylinder actuable to engage said assembly after the cable has been cut by said knife.

8. An automatic coiling machine according to claim 1, including a first pulley positioned to receive cable to be wound onto said take-up drum and to direct said cable to said assembly, said assembly including a second pulley rotatable on said support means, means being provided for moving said first pulley to remove slack from the cable immediately before the cable is cut by said knife and for moving said first pulley to the original position thereof after cutting of the cable so as to provide slack in the cable to facilitate feeding of the free end to said take-up drum.

9. An automatic coiling machine according to claim 1, wherein a rotatable roll is provided for driving the cable from said assembly to said take-up drum when said assembly is in said first position.

* * * * *